United States Patent [19]

Stephenson

[11] 4,410,229

[45] Oct. 18, 1983

[54] LATCHING MEANS IN MULTICONTACT CONNECTOR AND CONTACT TERMINAL FOR FLAT CABLE

[75] Inventor: Brian D. Stephenson, Camp Hill, Pa.

[73] Assignee: AMP Incorporated, Harrisburg, Pa.

[21] Appl. No.: 413,959

[22] Filed: Sep. 1, 1982

Related U.S. Application Data

[63] Continuation of Ser. No. 177,325, Aug. 12, 1980, abandoned.

[51] Int. Cl.[3] ..... H01R 11/20

[52] U.S. Cl. ..... 339/98; 339/97 P; 339/99 R

[58] Field of Search ..... 339/97 R, 97 P, 98, 339/99 R

[56] References Cited

U.S. PATENT DOCUMENTS 3,858,159 12/1974 Worth ..... 339/99 R 4,062,616 12/1977 Shaffer ..... 339/99 R

*Primary Examiner*—Eugene F. Desmond

*Attorney, Agent, or Firm*—Russell J. Egan

[57] ABSTRACT

An improved terminal is disclosed for securing a cover to a base of a multicontact connector while terminating flat multiconductor cable. Specifically, the improvement consists of a slotted terminal with latching ears directed normally from a plane defined by the slot defining arms of the terminal. As a result, undue flexure of the arms in relation to each other, which would cause a narrowing of the slot during mating of the cover to the base, is eliminated.

6 Claims, 8 Drawing Figures

LATCHING MEANS IN MULTICONTACT CONNECTOR AND CONTACT TERMINAL FOR FLAT CABLE

This is a continuation of application Ser. No. 177,325 filed Aug. 12, 1980, now abandoned.

BACKGROUND OF THE INVENTION

1. The Field Of The Invention

The present invention relates to an improved terminal for securing a cover to a base of a multicontact electrical connector for flat multiconductor cable and, in particular, to a slotted plate terminal in which any narrowing of the terminal slot during mating of the cover to the base is eliminated.

2. The Prior Art

Previous terminals which secured a cover to a base of a multicontact electrical connector for flat multiconductor cable each had a laterally extending barb on the free end of each of a pair of spaced-apart terminal arms, the arms defining a conductor receiving slot therebetween. When a conductor was inserted into the slot, both the conductor was distorted and the arms were deflected outwardly to a certain extent. As the cover was mated to the base, the terminal arms were initially flexed toward each other, causing a narrowing of the slot and a further permanent deformation of the conductor already in the slot. When the barbs cleared a shelf-forming neck in the apertures of the cover, the terminal arms spraing apart causing a widening of the slot which resulted in a loss of the resilient force and reduction of the integrity of the contact between the permanently deformed conductor and the terminal.

The known prior art is best represented by U.S. Pat. No. 3,820,055.

SUMMARY OF THE INVENTION

The present invention relates to an improved multicontact connector for terminating flat multiconductor cable. The connector has a base with a plurality of contact terminals mounted therein and a cover with a like plurality of terminal receiving passages. Each terminal has a mating portion and an oppositely directed insulation displacing, conductor engaging slotted plate portion formed by a pair of spaced apart arms defining a slot therebetween and extending normally from one side of the base. Each arm has an ear extending normally from a plane defined by the arms and adapted to latchingly engage with the cover.

It is therefore an object of the present invention to provide an improved means for securing a cover to a base of a multicontact connector for flat multiconductor cable utilizing slotted beam terminals which have no undue flexure with respect to slot width.

It is another object of the present invention to provide an improved slotted terminal in which movement of slot-defining arms into an aperture of an associated cover to latchingly engage therewith is accomplished without undue flexure of the arms with respect to the slot.

It is a further object of the present invention to provide an improved insulation piercing slotted plate terminal which can be readily and economically produced.

The means for accomplishing the foregoing objects and other advantages, which will be apparent to those skilled in the art, will be described in detail with reference to the accompanying drawings.

DETAILED DESCRIPTION OF THE PREFERRED EMBODIMENT

Figure 1:
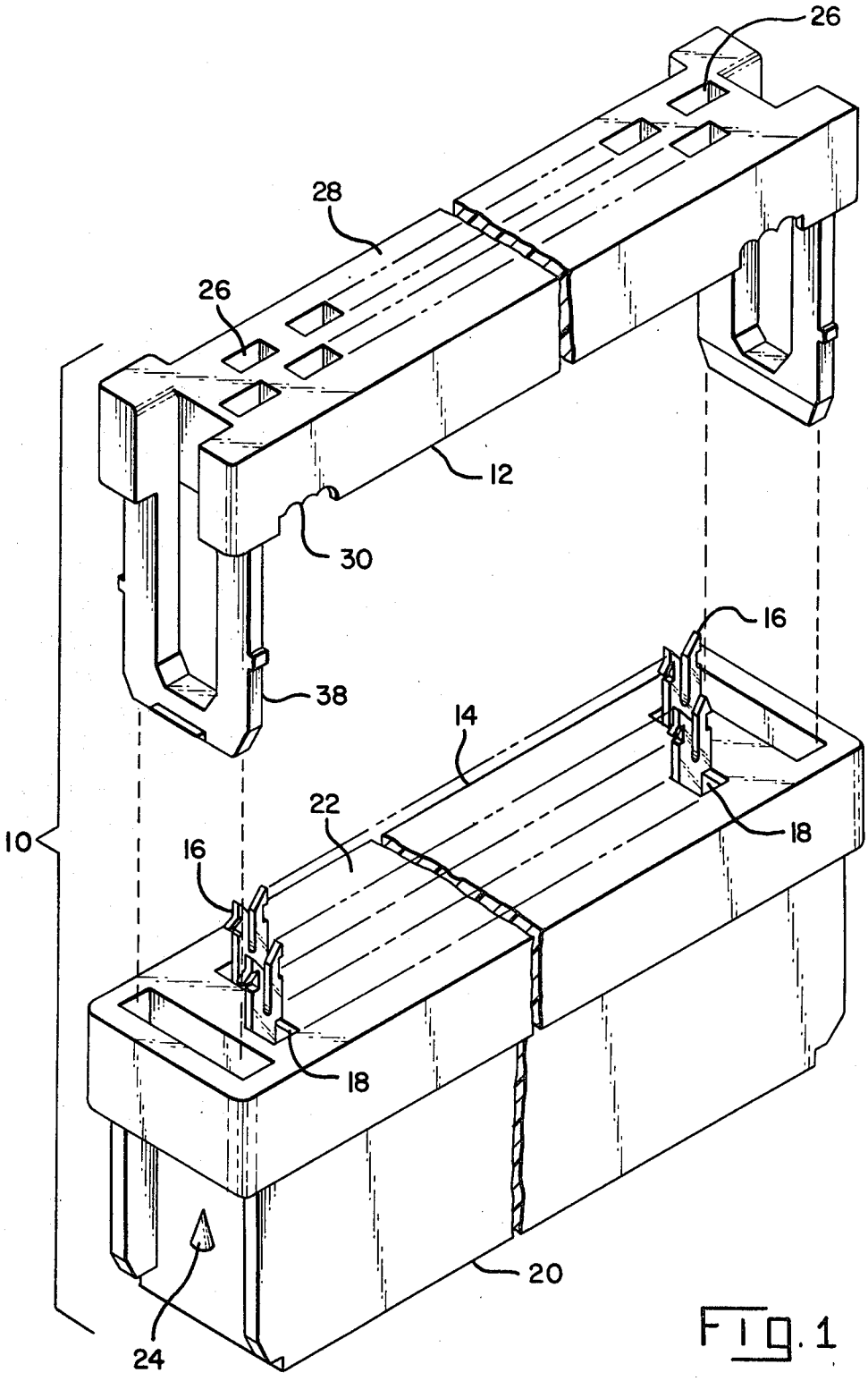
FIG. 1 is an exploded perspective view of a multicontact connector for flat multiconductor cable mounting terminals formed in accordance with the present invention.

An electrical multicontact connector 10 in accordance with the present invention, FIG. 1, comprises an elongated cover 12 and a base 14 both formed from rigid insulative material. The base has a plurality of terminals 16 mounted in a like plurality of terminal passages 18 extending between a mating face 20 and a cable receiving surface 22. The base also includes latching means 24.

Figure 4:
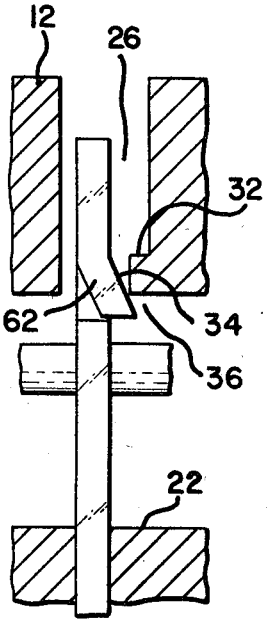
Figure 7:
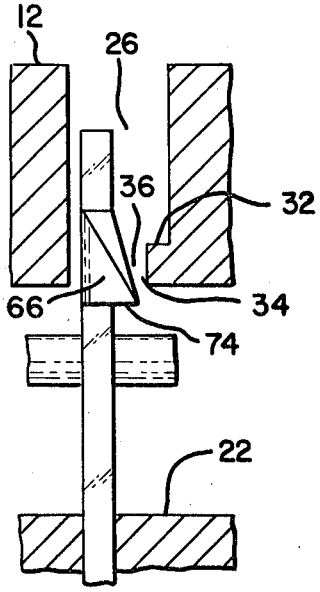

The cover 12 contains a like plurality of terminal receiving passages 26 each aligned to receive a respective terminal 16 mounted in the base 14. The passages 26 extend through the cover 12 from its upper side 28 to its fluted cable receiving lower side 30. Each passage 26 has a shelf 32 (see FIGS. 4 and 7) recessed from the upper side 28 of the cover and a relatively smaller passage 34 extending through to the fluted cable receiving lower side 30 of the cover, the opening 36 being offset relative to the upper portion of the passage 26. The cover further includes latching means 38 adapted to engage latching means 24 of the base.

Figure 8:
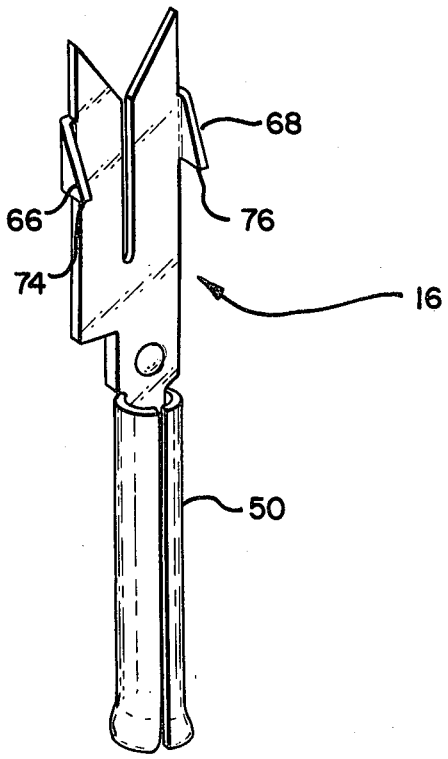
FIG. 8 is a perspective view of the second embodiment of a terminal in accordance with the present invention as shown in FIGS. 6 and 7.

Each terminal 16 (see FIGS. 5 and 8), includes an insulation piercing, conductor engaging first end 40 having a pair of spaced-apart arms 42, 44 defining a slot 46 therebetween, and a matable second end comprising a pin type connection 48 (as in FIG. 5) or a socket type connection 50 (as in FIG. 8). The upper portions of the arms 42, 44 are inclined at 52, 54 to form sharp points 56, 58 and a funnel entry 60 to slot 46. The free end of each arm is sharply pointed at 56, 58 to facilitate penetration of the insulation of a flat multiconductor cable (not shown). Intermediate the free end 56, 58 of each arm 42, 44 and the bottom of the slot 46 is an ear 62, 64 (in FIG. 5) and 66, 68 (in FIG. 8) directed normally to a plane defined by the arms 42, 44. Each ear has a shoulder 70, 72 (in FIG. 5) and 74, 76 (in FIG. 8) directed towards the bottom of the slot 46.

Figure 5:
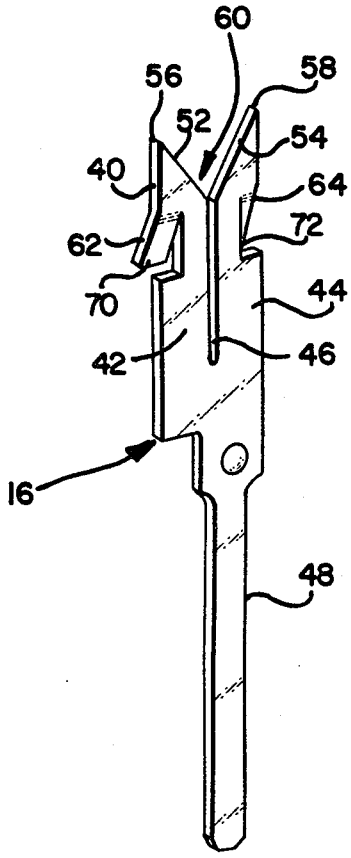
FIG. 5 is a perspective view of the first embodiment of a terminal in accordance with the present invention as shown in FIGS. 3 and 4.

FIGS. 5 and 8, respectively, illustrate first and second alternative embodiments of the ear. In FIG. 5, the ear 62, 64 is formed by a lance stamped out of the terminal arms in a direction normal to the plane defined by the arms. In FIG. 8, the ear 66, 68 comprises a fin which is formed in the plane of the arms and subsequently bent in a direction normal to the plane.

Figure 2:
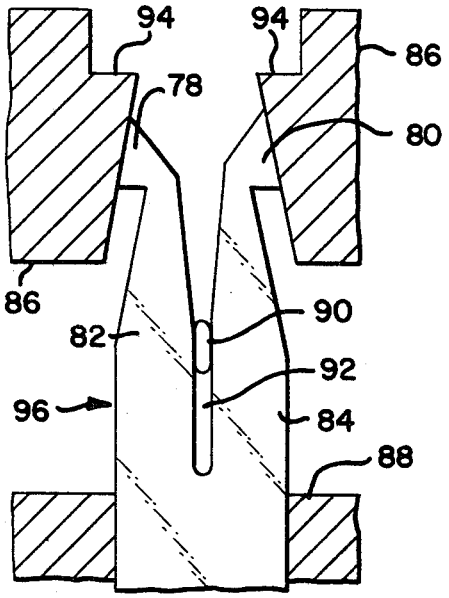
(PRIOR ART) FIG. 2
FIG. 2 is a vertical detail section through a connector cover and base showing a prior art terminal for latching the cover to the base.

The advantage of the normally directed ears 62, 64, 66, 68, is realized during the mating of the cover 12 to the base 14. As shown in FIG. 2, the prior art latching involved a laterally extending barb 78, 80 on the free end of each respective terminal arm 82, 84. As the cover 86 was mated to the base 88, with the conductor 90 already located in the slot 92 and permanently deformed, the terminal arms 82, 84 were flexed towards each other, causing a narrowing of the slot 92 and a further permanent deformation of the conductor 90, followed by a widening of the slot as the barbs 78, 80 latchingly engaged with the shelf 94 in the cover, which resulted in loss of the resilient force and reduction of the integrity of the contact between the conductor 90 and terminal 96.

Figure 3:
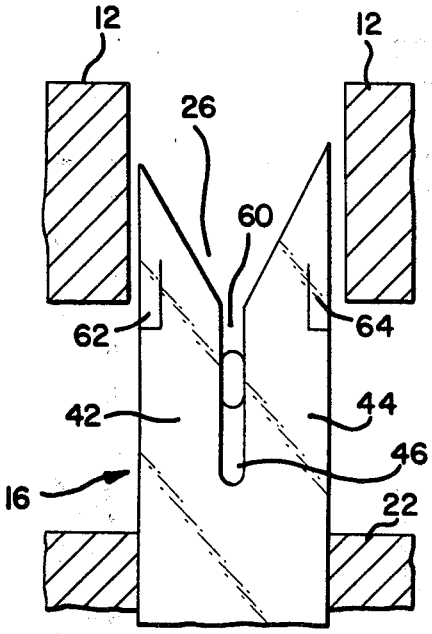
FIGS. 3 and 4 are front and side vertical detail sections, respectively, through a connector cover and base showing a first embodiment of the subject terminal during the mating of the cover to the base.
Figure 6:
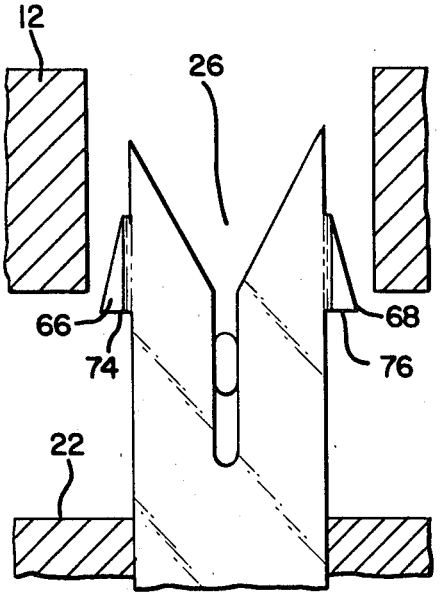
FIGS. 6 and 7 are front and side vertical detail sections, respectively, through a connector cover and base showing a second embodiment of the subject terminal during the mating of the cover to the base.

In accordance with the present invention, as shown in FIGS. 3 and 6, the passage 26 has a width somewhat larger than the lateral terminal width so that no flexure of the terminal arms 42, 44 towards each other occurs during mating of the cover 12 to the base 14. During this mating, the normally directed ear 62, 64 may flex in a direction normal to the plane of the arms to pass through the opening 36 before the shoulder 70, 72 latches with the shelf 32, as in FIG. 4; or the normally directed ear 66, 68 may bite through the shelf extension 34 before the shoulder 74, 76 latches with the shelf 32, as in FIG. 7. In either case, no narrowing of the terminal slot 46 will occur during mating, maintaining a resilient force and the integrity of the contact between the conductor and terminal.

The present invention may be subject to many modifications and changes without departing from the spirit or essential characteristics thereof. The present embodiments are therefore to be considered in all respects as illustrative and not restrictive of the scope of the invention.

What is claimed is:

1. An improved multicontact electrical connector for terminating flat multiconductor cable and having a base of insulating material with a plurality of terminal passages extending between a cable receiving surface and a mating face, an electrical terminal mounted in each of said terminal passages, each of said terminals having a wire receiving slot defined by a pair of insulation piercing spaced-apart arms, said arms extending normally beyond said cable receiving surface of said base, and a cover to be mated to said base against said cable receiving surface, said cover having terminal receiving passages extending therethrough aligned to accept said arms of said terminals, wherein the improvement comprises interengaging means including:

an ear on each of said arms directed normally from a plane defined by said arms, said ears located intermediate the free end of said arms and the bottom of said wire receiving slot, said ears each having a shoulder directed toward said bottom of said wire receiving slot;

a shelf in each of said terminal receiving passages in the cover extending parallel to said cable receiving surface of said base, said shelf engagable by said shoulders of said ears to latchingly secure said cover to said base whereby, movement of said arms in relation to each other causing a narrowing of said wire receiving slot during mating of said cover to said base is eliminated.

2. An electrical connector as recited in claim 1, in which each said ear directed normally from the respective arm comprises a lance stamped out of said terminal in a direction normal to the plane defined by said arms of said terminal.

3. An electrical connector as recited in claim 1, in which each said ear directed normally from the respective arm comprises a fin which is formed in the plane defined by said arms of said terminal and bent in a direction normal to said plane.

4. An improved stamped and formed electrical terminal comprising:

an elongated metal member having an insulation piercing, conductor engaging first end and a matable second end, said first end having a pair of insulation piercing, spaced-apart arms defining a wire receiving slot therebetween, an ear on each of said arms directed normally from a plane defined by said arms, said ears being located intermediate the free end of said arms and the bottom of said wire receiving slot, said ears having a shoulder directed towards the bottom of said slot, whereby upon movement of a conductor laterally of its axis into said slot, the edges of said slots pierce the insulation of said conductor and establish electrical contact therewith, and subsequent movement of said arms into an aperture of an associated cover engages latchingly therewith without undue flexture of said arms with respect to said slot.

5. An electrical terminal as recited in claim 4, in which each said ear directed normally from the respective arm comprises a lance stamped out of said terminal in a direction normal to the plane defined by said arms of said terminal.

6. An electrical terminal as recited in claim 4, in which each said ear directed normally from the respective arm comprises a fin which is formed in the plane defined by said arm of said terminal and bent in a direction normal to said plane.

* * * * *